US006051279A

United States Patent [19]

Gualco et al.

[11] Patent Number: 6,051,279

[45] Date of Patent: Apr. 18, 2000

[54] METHOD AND DEVICE FOR FORMING POROUS CERAMIC COATINGS, IN PARTICULAR THERMAL BARRIER COATING, ON METAL SUBSTRATES

[75] Inventors: Giuseppe Carlo Gualco, Alessandria; Sergio Corcoruto, Turin; Andrea Campora, Quiliano, all of Italy

[73] Assignee: Finmeccanica S.P.A. Azienda Ansaldo, Genoa, Italy

[21] Appl. No.: 09/118,501

[22] Filed: Jul. 17, 1998

[30] Foreign Application Priority Data

Jul. 18, 1997 [EP] European Pat. Off. ..... 97830367

[51] Int. Cl.[7] ..... C23C 4/10; C23C 4/18

[52] U.S. Cl. ..... 427/447; 427/453

[58] Field of Search ..... 427/447, 453

[56] References Cited

FOREIGN PATENT DOCUMENTS

| | | |
|---|---|---|
| 0 244 343 | 4/1987 | European Pat. Off. . |
| 0 303 493 A1 | 8/1988 | European Pat. Off. . |
| 0 532 134 A1 | 8/1992 | European Pat. Off. . |
| 2-217458 | 8/1990 | Japan . |
| 5-106016 | 4/1993 | Japan . |
| 6-88198 | 3/1994 | Japan . |
| 2 152 079 | 12/1984 | United Kingdom . |

OTHER PUBLICATIONS

Abstract, Publication No. 06081292, dated Mar. 22, 1994, Ishikawajima Harima Heavy Ind. Co. Ltd.

Abstract, Publication No. 59222566, dated Dec. 14, 1984, Kawasaki Heavy Ind. Ltd.

Abstract, Publication No. 62050455, dated Mar. 5, 1987, Kanmeta Eng KK.

Abstract, Publication No. 04045253, dated Feb. 14, 1992, Ishikawajima Harima Heavy Ind. Co. Ltd.

Abstract, Publication No. 01176063, dated Jul. 12, 1989, Toyota Motor Corp.

*Primary Examiner*—Katherine A. Bareford

*Attorney, Agent, or Firm*—Darby & Darby

[57] ABSTRACT

Two different powders, one ceramic and the other of polymer particles, are fed separately into a jet of plasma of a conventional torch of a plasma spraying device by means of separate supply devices having respective powder injectors. The injection parameters of the two powders are established independently to achieve effective fusion of the ceramic particles and prevent complete combustion of the polymer particles. More specifically, the ceramic powder is injected along the axis of the jet of plasma, while the polymer powder is injected into a peripheral portion of the jet, at a predetermined distance from the jet axis, so that some of the polymer particles are incorporated in the ceramic coating deposited on a component for coating; and the polymer is subsequently removed by medium-temperature heat treatment to leave a porous ceramic coating with excellent thermal insulation properties.

5 Claims, 9 Drawing Sheets

METHOD AND DEVICE FOR FORMING POROUS CERAMIC COATINGS, IN PARTICULAR THERMAL BARRIER COATING, ON METAL SUBSTRATES

BACKGROUND OF THE INVENTION

The present invention relates to a method and device for forming porous ceramic coatings on metal substrates, in particular thermal barrier coatings on gas turbine components; to ceramic coatings formed by such a method; and to metal components applied with such coatings.

As is known, to increase the operating temperature of gas turbine combustion chambers for the purpose of improving efficiency of the turbine and reducing pollutant emissions (particularly nitric oxide), the turbine components subjected to critical thermal and oxidation conditions are made of special high-resistance materials, such as nickel-based superalloys, and are protected by ceramic or so-called thermal barrier (TBC) coatings typically formed by plasma spraying, which consists in spraying ceramic powder on to the workpiece by means of a plasma gas jet.

Despite the already high performance of known thermal barrier coatings, particularly in terms of gas combustion temperature and component life and reliability, further improvement in insulation capacity is hoped for to enable an even greater increase in efficiency of the turbine and a further reduction in pollutant emissions.

The efficiency of thermal barrier coatings in ensuring maximum thermal insulation is also known to increase in proportion to the porosity of the ceramic deposit. Thermal barrier coatings with a porous structure therefore provide for better insulation as compared with compact coatings, but involve complex adjustments in optimum ceramic deposition parameters to achieve good mechanical properties and high deposition efficiency (defined as the adhesion probability of the sprayed particles, i.e. the ratio between the material actually deposited and the powder supplied to the plasma torch). As a result, porous thermal barrier coatings are generally characterized by low deposition efficiency (and hence high consumption of ceramic material) and poor mechanical performance.

Finally, known thermal barrier coatings are normally of limited thickness—less than 1 mm—due to the tendency of thicker ceramic coatings to become detached as a result of the rapid variations in temperature to which the components are subjected.

SUMMARY OF THE INVENTION

It is an object of the present invention to provide a straightforward, highly effective method of forming, on metal substrates, porous ceramic coatings involving none of the aforementioned drawbacks, and which in particular provide for low thermal conductivity, high porosity, and good mechanical characteristics.

According to the present invention, there is provided a method of forming porous ceramic coatings, in particular thermal barrier coatings, on metal substrates, the method comprising a deposition step for depositing a ceramic coating on a metal substrate by means of a jet of plasma, and wherein said substrate is sprayed with a ceramic powder in a jet of plasma gas; characterized in that, in the course of said deposition step, said substrate is sprayed with a polymer powder simultaneously with said ceramic powder and by means of the same jet of plasma, said ceramic powder and said polymer powder being injected separately and independently into said jet of plasma gas so that at least some of the particles constituting said polymer powder are incorporated in said ceramic coating, said ceramic powder being injected along an axis of said jet of plasma gas, and said polymer powder being injected into a peripheral portion of said jet, at a predetermined distance from said axis of the jet; and characterized by also comprising, after said step of depositing said ceramic coating, a step of removing said polymer particles incorporated in said coating.

The characteristics of the jet of plasma gas—in particular quantity and velocity of the gas, supply current, and power—are such as to optimize fusion and deposition on the metal substrate of the pure ceramic powder.

The step of removing the polymer particles comprises heat treatment during which the metal substrate with the ceramic coating is maintained at a predetermined temperature, higher than the decomposition and/or evaporation temperature of the polymer particles, for a predetermined time sufficient to completely decompose and/or evaporate the polymer particles.

Said heat treatment is preferably conducted at 600° C. for two hours in air or a vacuum.

Unlike traditional methods, the method according to the invention therefore provides for regulating the parameters of the plasma torch to achieve maximum deposition of the ceramic powder (hence, minimum consumption of material) and coatings with good thermal and mechanical characteristics, with no recourse to the adjustments normally required for obtaining high-porosity coatings; simultaneous spraying of the polymer powder only slightly reduces deposition efficiency, and in no way impairs the mechanical properties of the coating; and, being determined solely by the polymer/ceramic ratio, the porosity of the coating may be varied easily during deposition to produce coatings with a given degree of porosity.

It is a further object of the present invention to provide a device for implementing the method briefly described above.

According to the present invention, therefore, there is provided a plasma jet device for forming porous ceramic coatings, in particular thermal barrier coatings, on metal substrates, the device comprising a torch for generating a jet of plasma gas; supporting means for supporting said metal substrates for coating; and first supply means for supplying a first powder to said plasma torch; characterized by also comprising second supply means for supplying a second powder to said plasma torch, and for supplying said plasma torch with said second powder independently from said first supply means.

More specifically, the device comprises first and second regulating means for respectively regulating said first and second supply means, and for independently varying the supply parameters of said powders to said jet of plasma.

According to a preferred embodiment, said first and said second supply means respectively comprise at least a first and at least a second injector for respectively supplying said first and said second powder to said jet of plasma; said first and said second regulating means respectively varying the distance between an axis of the jet of plasma gas and said at least a first and said at least a second injector (injection distance).

Preferably, said at least a first injector and said at least a second injector respectively inject said first powder along an axis of said jet of plasma gas, and said second powder into a peripheral portion of said jet, at a predetermined distance from said axis of the jet.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
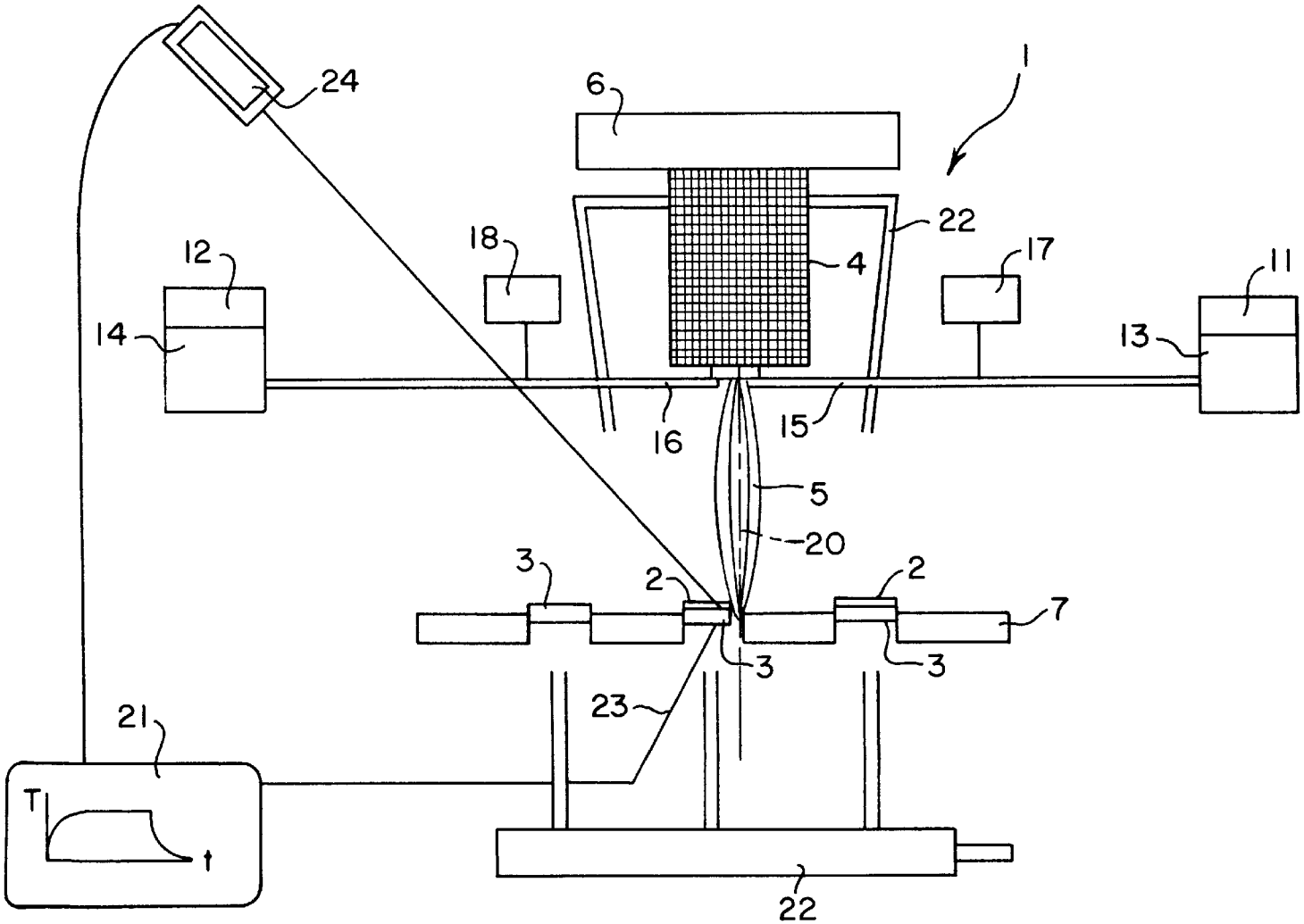
FIG. 1 shows, schematically, a plasma jet device for forming porous ceramic coatings on metal substrates in accordance with the present invention.

Number 1 in FIG. 1 indicates a plasma jet device for forming porous ceramic coatings 2 on metal substrates 3, e.g. gas turbine metal components.

Device 1 comprises a substantially known plasma torch 4 for generating a jet of plasma gas 5 and fitted to a movable, e.g. automatically controlled, element 6; and supporting means 7 for supporting, rotating and/or translating with respect to plasma torch 4 the metal components 3 for coating.

Plasma torch 4 may be of any known type capable of generating plasma gases, e.g. of argon and/or hydrogen and/or helium, with which to spray high-melting-point ceramic materials.

According to the invention, device 1 also comprises two supply units 11 and 12 for supplying torch 4 with respective powders 13 and 14: unit 11 supplies torch 4, by means of an injector 15, with a known ceramic powder, e.g. zirconia powder partly stabilized with yttria; and unit 12 supplies torch 4, by means of an injector 16, with a polymer powder, e.g. a powdered aromatic polyester.

Different types of both ceramic and polymer powders may of course be used: in particular, any commercial ceramic powder for thermal barrier coatings, providing the particle shape and size are suitable for plasma jet deposition; and any powdered polymer whose particles are capable of resisting the plasma jet process without complete combustion, evaporation or decomposition, and can be removed by treatment compatible with the material for coating and with the ceramic part of the coating, as explained later on.

Supply units 11, 12 provide for independently supplying respective powders 13, 14, for which purpose, units 11, 12 comprise respective regulating means 17, 18 for independently varying the supply parameters of powders 13, 14 to torch 4 (e.g. flow rate of the powders, pressure and flow of the vector gas, injection distance and angle). In particular, regulating means 17 provide, among other things, for regulating the distance between the outlet of injector 15 and an axis 20 of the plasma jet (injection distance), and regulating means 18 for regulating the distance between axis 20 and the outlet of injector 16.

Device 1 also comprises known means 21 for detecting the temperature of components 3 throughout deposition of coating 2; and known cooling means 22, e.g. air-cooling means, for controlling process temperature. In the non-limiting example shown in FIG. 1, detecting means 21 comprise thermocouples 23 for detecting the temperature of the base material of components 3; and infrared pyrometers 24 for detecting the surface temperature of coating 2.

Device 1 may be used to implement the method of forming porous ceramic coatings according to the present invention.

According to the method, in fact, ceramic powder 13 and polymer powder 14 are supplied independently by respective supply means 11, 12 to the same high-temperature, high-speed jet of plasma gas 5 generated by torch 4, so as to deposit on metal substrates 3 ceramic coatings 2 incorporating a given number of polymer particles. The polymer is subsequently removed by medium-temperature heat treatment to leave a porous pure ceramic coating with excellent thermal insulation properties.

The operating parameters of torch 4 (gas flow, current intensity, power, transverse speed) are regulated to achieve optimum fusion and deposition of the pure zirconia 13, with small adjustments for the presence of polymer powder 14.

By appropriately regulating the supply parameters of ceramic powder 13—in particular, the position of injector 15, which is movable with respect to torch 4 by regulating means 17—zirconia powder 13 is supplied to plasma jet 5 along axis 20 where the temperature of the jet is highest; and the spraying distance (between the outlet of injector 15 and component 3 for coating) is such that the zirconia particles travel along plasma jet 5 long enough to ensure complete fusion.

Again by appropriately regulating the supply parameters—in particular, the position of injector 14, which is movable by regulating means 18—the particles of polymer powder 14, on the other hand, are injected into a peripheral portion of plasma jet 5, at a predetermined distance from jet axis 20, and therefore travel in a high-speed but medium-temperature gas in which they are accelerated towards the substrate defined by component 3 for coating, and are heated so as to melt without burning, evaporating or decomposing. Some of the polymer particles therefore reach the surface of component 3 together with the ceramic particles, and are incorporated in coating 2 being formed.

The possibility of moving plasma torch 4 and component 3 in relation to each other—by means of movable element 6 to which torch 4 is fitted, and support 7 supporting component 3—provides for depositing coating 2 over the entire surface of the component.

The coating 2 formed on the surface of component 3 is therefore defined by a ceramic matrix incorporating a given number of polymer particles—obviously, only some of the original polymer particles are incorporated in the coating, due to combustion of failure of some of the particles to adhere to the surface; and, by appropriately regulating the process temperature and deposition speed, a predetermined density of microfractures or so-called vertical cleavage cracks may be achieved in the coating.

A variation of the method according to the present invention provides, before depositing ceramic coating 2, for depositing on metal substrate 3 a highly oxidation-resistant binding layer for improving adhesion of top coating 2 to metal substrate 3, e.g. a binding layer of ceramic powder comprising 48.2% Ni, 21.8% Co, 16.9% Cr, 12.2% Al, 0.6% Y.

Also, before depositing ceramic coating 2, metal substrate 3 is preferably preheated, e.g. by means of plasma torch 4 itself.

Whichever the case, once coating 2 has been deposited to the desired thickness, components 3, in accordance with the method of the present invention, are heat treated to remove the polymer inclusions from the ceramic matrix; for which purpose, components 3 are loaded into a furnace (an air or vacuum furnace) and maintained at a relatively low temperature—but higher than the decomposition and/or combustion and/or evaporation temperature of the polymer—long enough to ensure complete removal of the polymer.

In the case of a polymer powder comprising an aromatic polyester, for example, heat treatment may be conducted at 600° C. for two hours; which conditions in no way damage the metal materials normally used for gas turbine components, even if heat treated in air. Particularly sensitive materials, however, may be vacuum treated.

Unlike traditional methods, the method according to the invention therefore provides for simultaneously and independently injecting a ceramic powder and a polymer powder separately into the plasma jet when depositing the ceramic coating; and the supply parameters of the two powders are so established as to optimize fusion and deposition of the ceramic powder, and ensure at least some of the polymer particles reach the ceramic coating being formed. For which purpose, it is essential that the supply parameters of the two powders, in particular the respective injection distances, be adjustable independently.

Highly porous ceramic coatings of excellent thermal and mechanical characteristics and even considerable thickness may therefore be formed to a good degree of deposition efficiency. In particular, the working life of even thick coatings of up to 1.5 mm subjected to repeated thermal stress is far superior to that of traditional dense coatings of similar thickness; and coatings of up to 25% porosity are obtainable, with a corresponding reduction in thermal conductivity as compared with similar compact coatings.

The most critical aspect of the research work carried out by the Applicant's technicians was the reduction in deposition efficiency resulting from the polymer added to the zirconia: adhesion of the zirconia particles to the coating being formed seems to be strongly affected by the incoming polymer particles or those already deposited on the surface of the coating.

The method according to the invention, however, provides for a minimum reduction in the deposition efficiency of the ceramic powder due to simultaneous spraying of the polymer powder. For example, the deposition efficiency of a 20% porous coating is about 50%; a coating of the same porosity but formed using the conventional method (appropriately regulating process parameters, such as powder quantity, injection distance, etc.) has a deposition efficiency of less than 35%; and the deposition efficiency of a conventional dense coating is about 60%. A reduction to 50% is therefore more than acceptable, bearing in mind the corresponding reduction in thermal conductivity, which enables the total thickness of the coating to be reduced without affecting its insulating properties.

In short, the method according to the invention provides for consuming less ceramic powder, by ensuring a good degree of deposition efficiency, and for obtaining high-porosity coatings with improved thermal and mechanical properties, by virtue of so selecting the process parameters as to optimize deposition of the ceramic powder, with no recourse to the adjustments normally required for obtaining high porosity.

The invention will now be described further with reference to a number of example embodiments.

EXAMPLE 1

A number of porous ceramic coatings were test deposited using the method according to the invention, and the process parameters varied to determine the best combination.

Testing was conducted using disk-shaped metal specimens (25 mm in diameter, 5 mm thick) of a nickel-based superalloy normally used for gas turbine components and known as IN-738.

The surface of the specimens was first sandblasted to a surface roughness of Ra=7 $\mu$m; and a first 240 $\mu$m thick metal binding layer was applied using a conventional plasma spraying technique. The composition of the binding layer (Praxair powder NI-171: 48.2% Ni, 21.8% Co, 16.9% Cr, 12.2% Al, 0.6% Y) was found to ensure good long-term oxidation resistance, and its surface roughness (Ra=10 $\mu$m) to ensure good adhesion of the top coating.

The specimens so prepared were then applied with a thermal barrier coating by combined plasma spraying ceramic and polymer powders using the device described with reference to FIG. 1.

More specifically, the ceramic powder used was a normal zirconia powder partially stabilized with yttria (containing 93% $ZrO_2$, 7% $Y_2O_3$) and having a low silica and monocline phase content (below 0.2% and 8% respectively); and the polymer powder used was a commercial aromatic polyester powder, Metco 600 ekonol.

Figure 2:
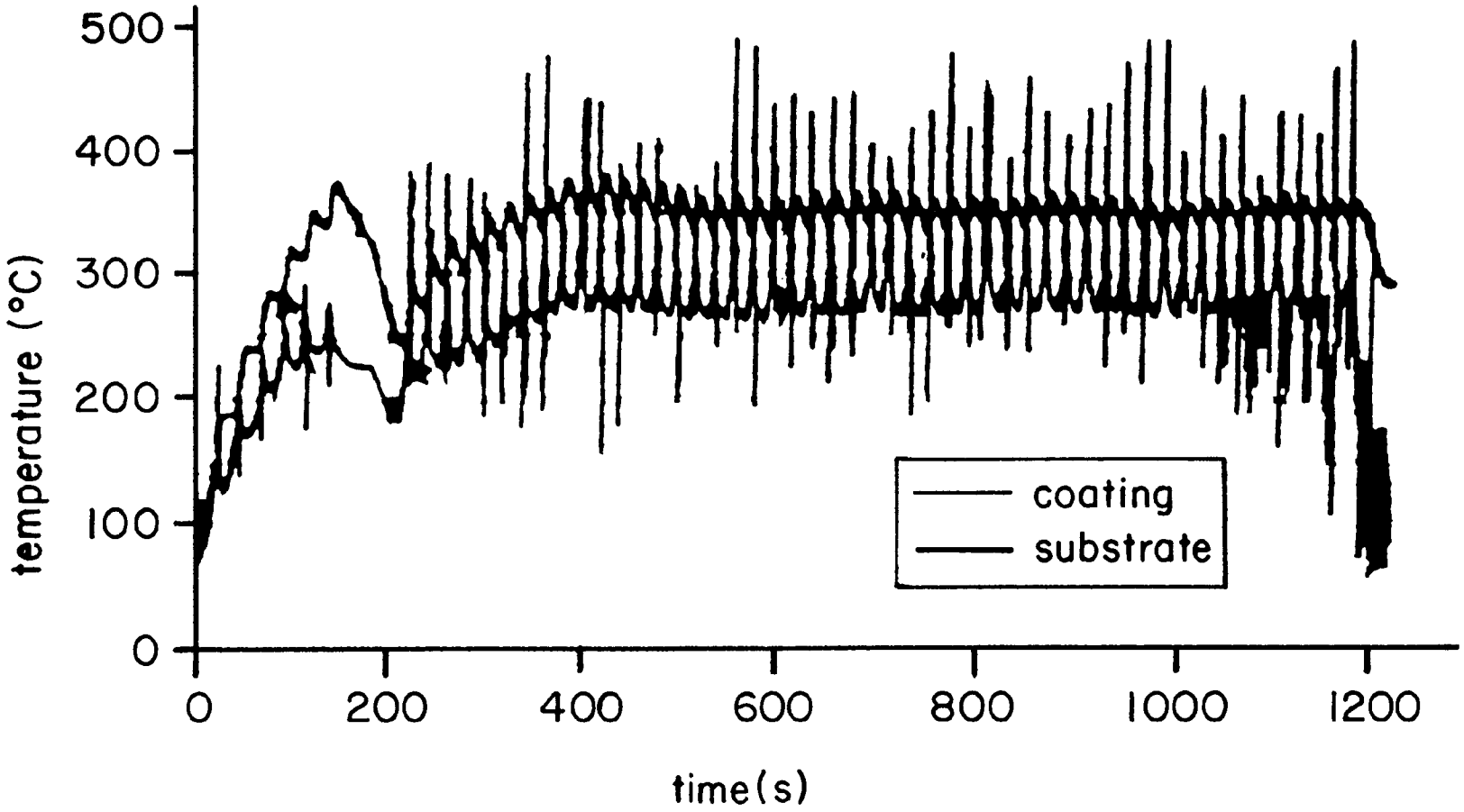
FIG. 2 shows a time-temperature graph relative to a plasma jet deposition method in accordance with the present invention.

Six specimens were processed together in each deposition test, and the plasma torch set to a meandering trajectory; during deposition, the temperatures of the base material and the coating surface of one of the specimens were detected respectively by a thermocouple and an infrared pyrometer; the specimens were preheated by the torch itself before commencing injection of the powders; and temperature was controlled by means of air-cooling nozzles both on the torch and the back of the specimens. FIG. 2 shows a time versus temperature graph recorded during a typical deposition test, and in which each peak corresponds to one pass of the torch over the specimen.

The operating parameters resulting in the best combination of structural characteristics (high porosity, good surface smoothness, good adhesion to the binding layer) together with good deposition efficiency are summarized in Table 1.

TABLE 1

| OPERATING PARAMETER | VALUE |
|---|---|
| argon flow | 35 l/min |
| hydrogen flow | 15 l/min |
| current intensity | 600 A |

TABLE 1-continued

| OPERATING PARAMETER | VALUE |
|---|---|
| voltage | 70 V |
| zirconia supply speed | 58 g/min |
| polymer supply speed | <5% |
| spraying distance | 75 mm |

The main difference as compared with the values normally used for depositing pure zirconia is the spraying distance, which is reduced to 75 mm (as compared with a normal distance of about 100 mm).

Further deposition tests were conducted in the same way as described above (in particular, using the operating parameters in Table 1), but varying other process parameters, in particular, spraying temperature, deposition speed and polymer supply speed, as shown in Table 2.

TABLE 2

| OPERATING PARAMETER | VALUE |
|---|---|
| spraying temperature | 170 ÷ 350° C. |
| deposition speed | 24 ÷ 30 μm/pass |
| polymer supply speed | 1.1 ÷ 2.9 g/min |

Numerous specimens were formed with a roughly 1.5 mm thick coating, and were analyzed as to structure and thermal and mechanical properties as described in the example below.

EXAMPLE 2

The microstructure of the ceramic coatings formed as described in the foregoing examples was characterized as follows.

The specimens were first vacuum impregnated with a low-viscosity resin, then cut with a diamond circular saw and again vacuum impregnated to obtain normal 30 mm diameter specimens: the presence of the resin in most of the pores and cracks, as confirmed under a microscope, reduces damage during preparation of the specimens. The samples were then ground with a 40 μm diamond grinding wheel, and polished with abrasive clothes and silicon monoxide particle suspensions.

The microstructure was analyzed by conventional micrographic methods and quantitatively by analyzing the image to determine, in particular, thickness, vertical cleavage crack density and porosity (the latter expressed as the mean value of ten measurements).

Figure 3:
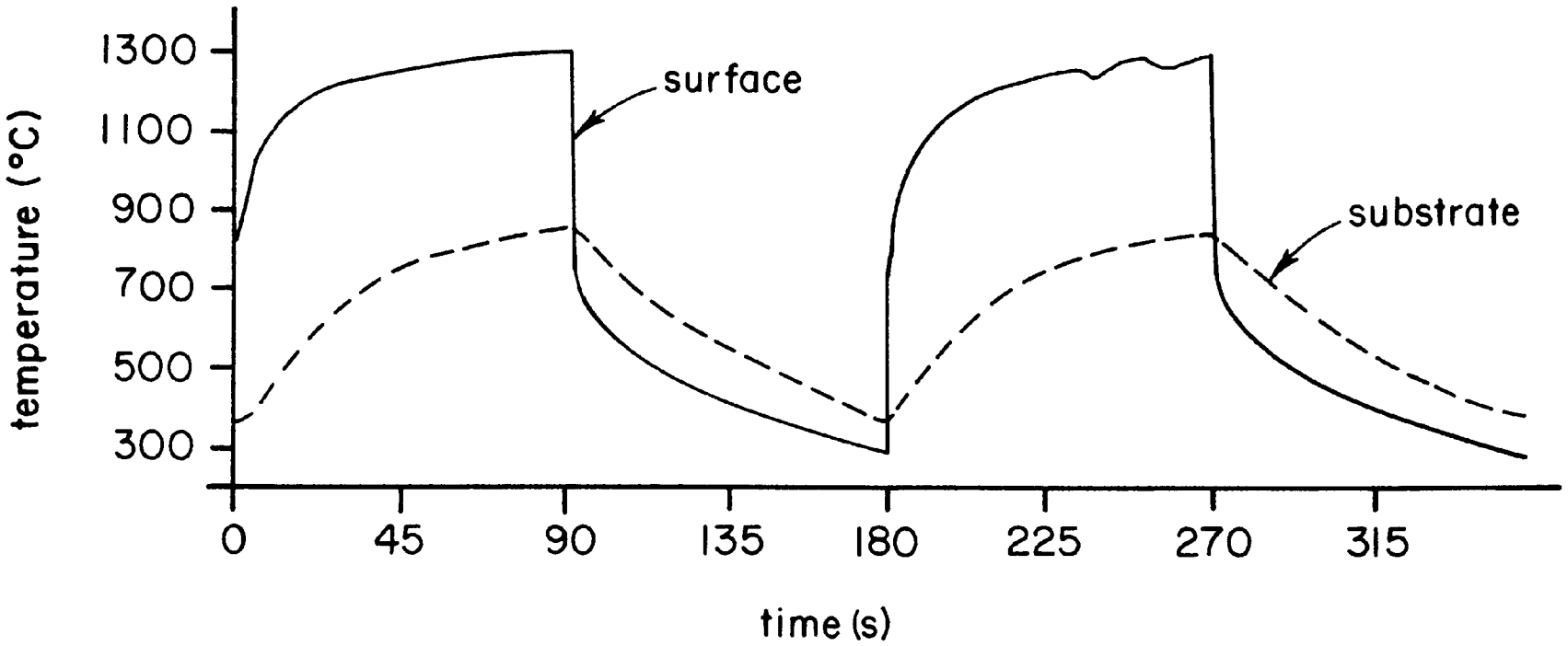
FIG. 3 shows a thermal cycle for evaluating the working life of a coated component subjected to repeated thermal stress.

A number of particularly significant thermal and mechanical characteristics were assessed: in particular, the ability of the coatings to withstand repeated thermal stress (so-called thermal shock tests) by subjecting the specimens to thermal cycles of the type shown in FIG. 3. Alternating between an oxygen-propane torch and a compressed air cooling nozzle, the specimens were subjected to symmetric 180-second heating-cooling cycles, with temperatures varying between 400° and 860° C. for the base metal material, and between 400° and roughly 1300° C. for the coatings.

The thermal diffusivity (from which, as is known, conductivity is determined) and the coefficient of thermal expansion of the coatings were determined by standard methods. To prevent the metal substrate affecting the properties of the coatings, both the above tests were performed on the coating alone, without the substrate, which was dissolved in a solution of equal parts of nitric and hydrochloric acid.

Finally, the principal mechanical characteristics were determined by standard methods for testing ceramic materials.

EXAMPLE 3

Table 3 shows the main results of the metallographic analysis performed as described in the above example, together with the spraying parameters and life under repeated thermal stress (thermal shock) of the corresponding specimens.

TABLE 3

| test | polymer [%] | $T_{sub}$ [° C.] | $T_{coat}$ [° C.] | porosity [%] | thickness [mm] | deposition speed [μm/pass] | cleavage cracks [l/mm] | thermal shock life |
|---|---|---|---|---|---|---|---|---|
| BH | 2 | 210 | 210 | 18 | 1.47 | 29.4 | 1.2 | 131 |
| BI | 2 | 210 | 280 | 19 | 1.34 | 26.8 | 0.8 | 138 |
| BN | 2 | 230 | 310 | 20 | 1.43 | 28.6 | 1.3 | 150 |
| BO | 2 | 170 | 210 | 19 | 1.32 | 26.4 | 1.4 | 299 |
| BR | 2 | 230 | 270 | 19 | 1.46 | 29.2 | 1.2 | 196 |
| BS | 2 | 350 | 300 | 22 | 1.38 | 27.6 | 1.8 | 249 |
| BL | 5 | 340 | 340 | 22 | 1.19 | 23.8 | 0.4 | 42 |
| BM | 5 | — | 400 | 22 | 1.23 | 24.6 | 0.7 | 133 |

The deposition efficiency of a sample coated at a polymer supply speed of 2% and of 19% porosity was measured at 48%, as compared with 60% efficiency and 5% porosity of a comparative specimen without the polymer.

This is more than satisfactory, considering the deposition efficiency of similar porous thermal barrier coatings formed using the conventional method (adjusting spray parameters, such as powder quantity, spraying distance, etc.) is normally 35%.

Figure 4:
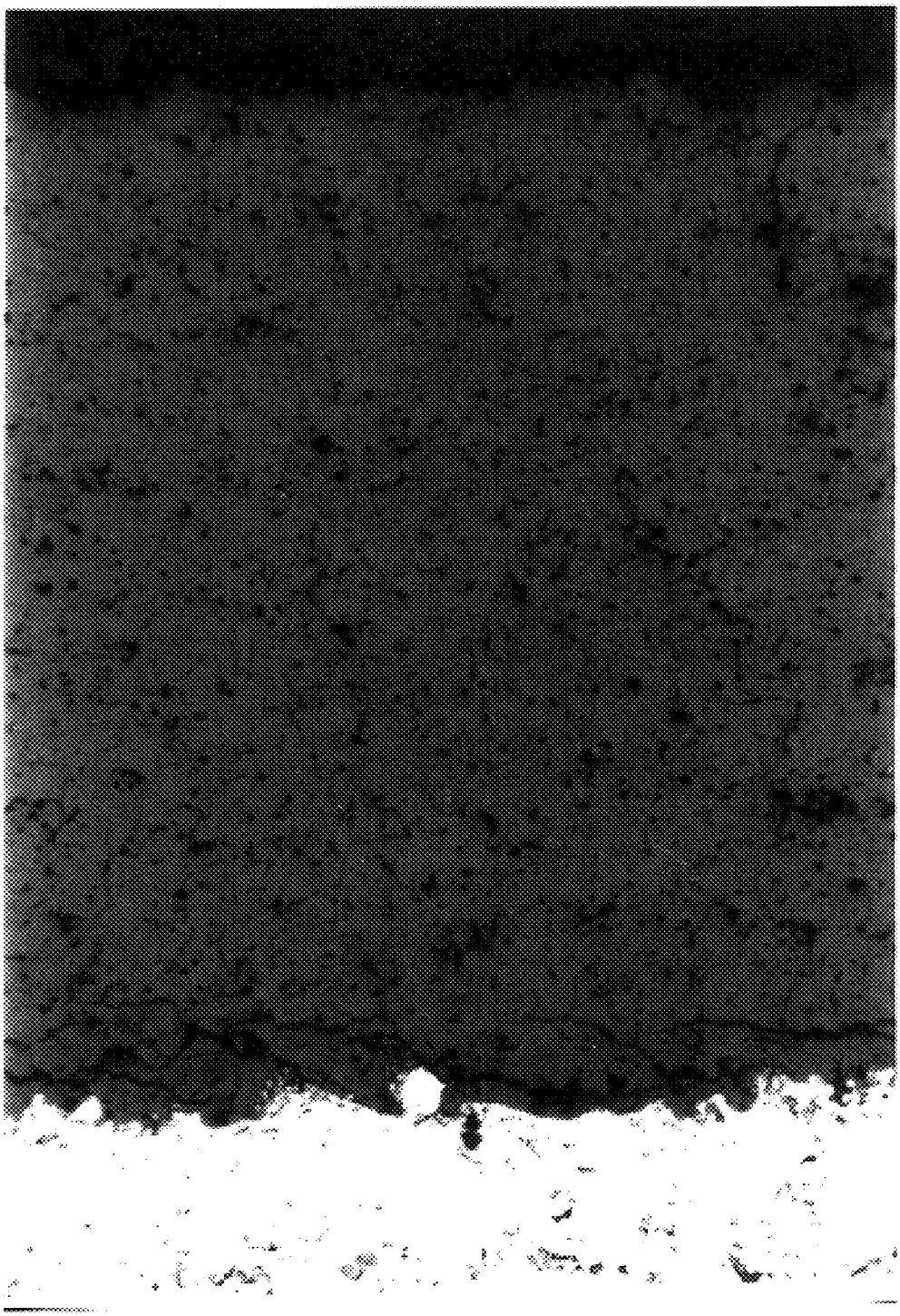
FIGS. 4 and 5 show the microstructures (100 times magnification) of a typical coating formed in accordance with the invention, and a dense coating formed by traditional plasma spraying without the addition of a polymer.
Figure 5:
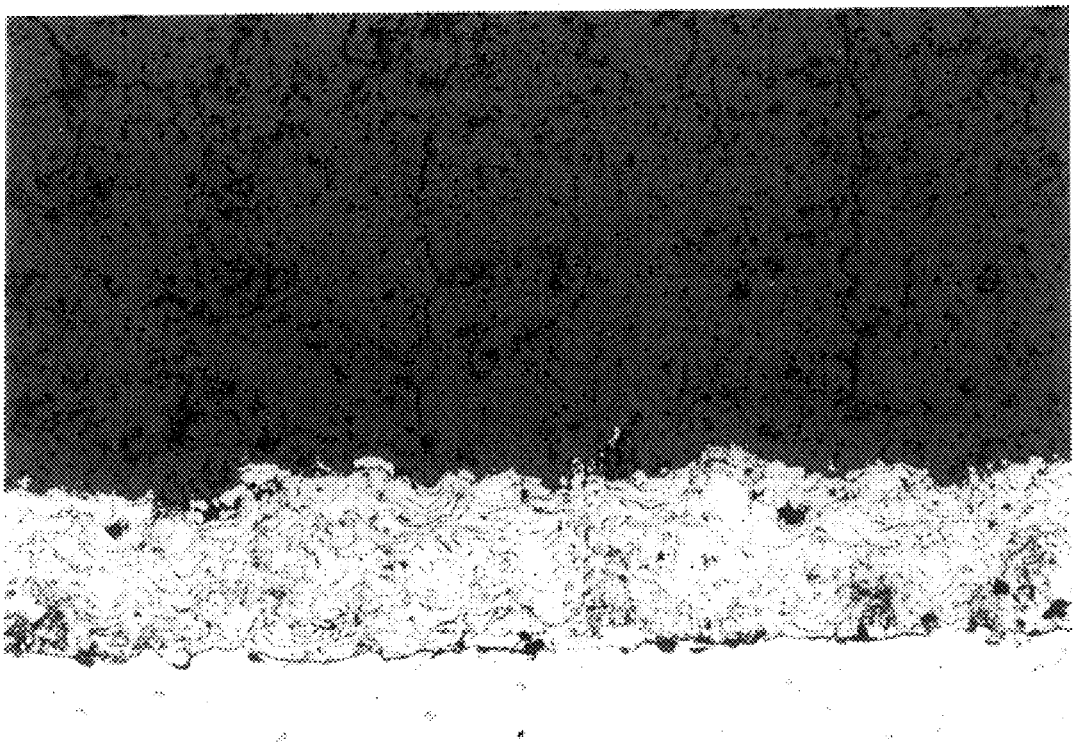
Figure 6:
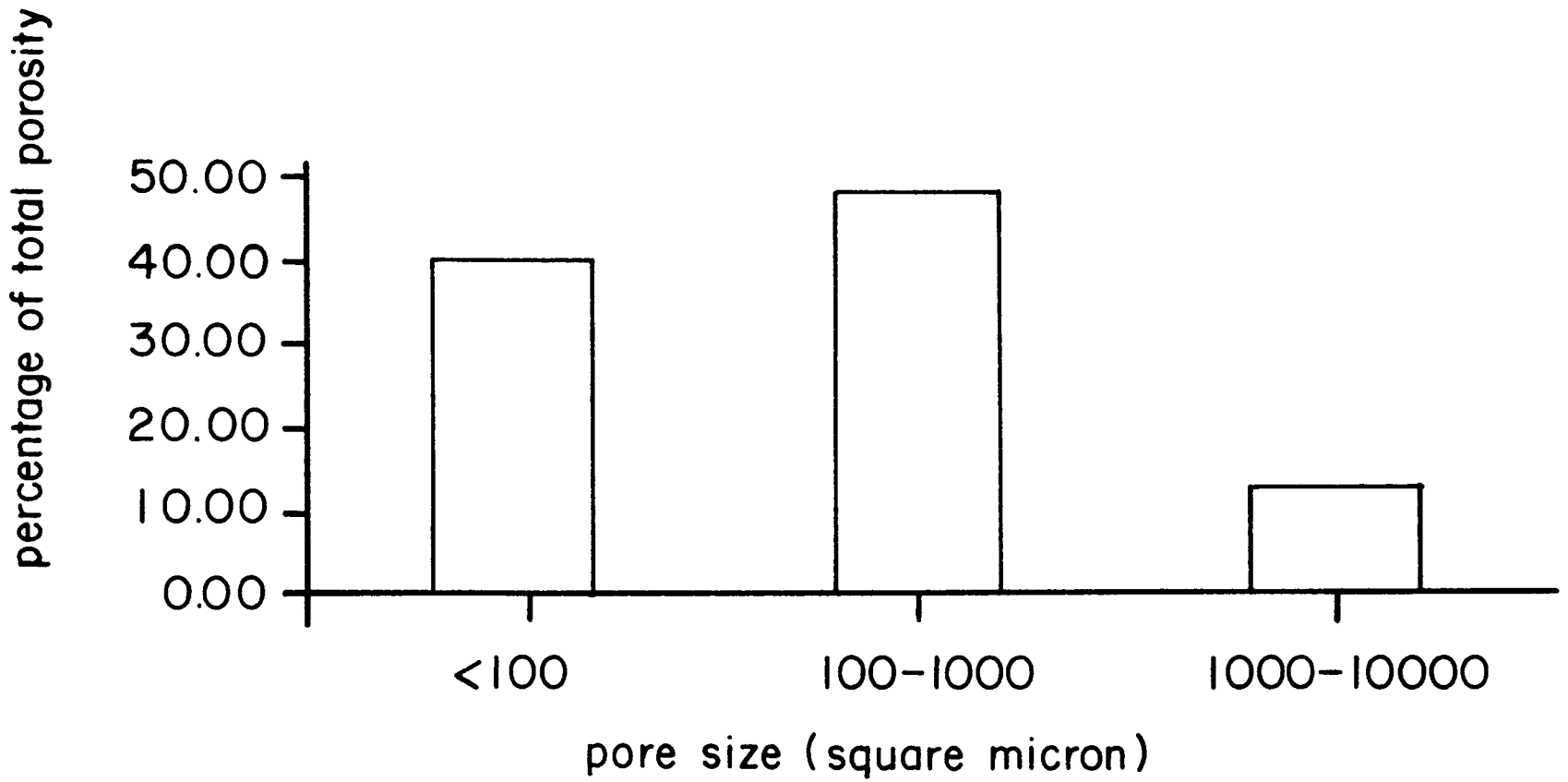
FIG. 6 shows a graph illustrating the typical pore size distribution of a porous coating in accordance with the invention.

FIG. 4 shows the microstructure of thermal barrier coatings according to the invention, and FIG. 5, by way of comparison, a dense coating sprayed without the addition of a polymer. Using the method according to the invention, porosities of up to 22% were obtained, with a typical pore size distribution as shown in FIG. 6.

Figure 7:
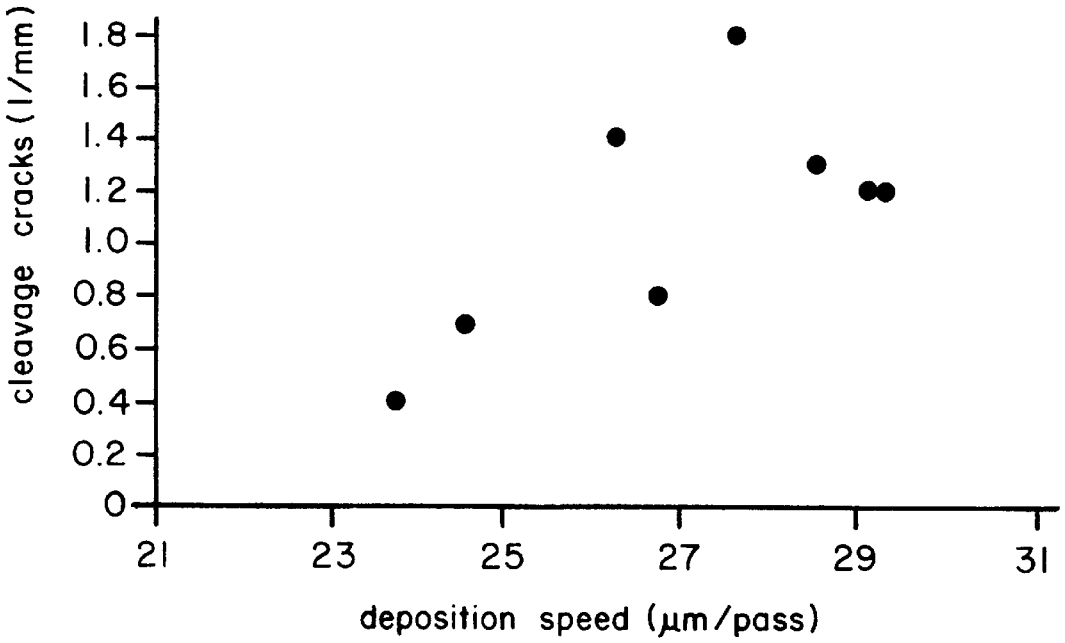
FIG. 7 shows a graph illustrating vertical cleavage crack density versus deposition rate of coatings in accordance with the invention.

As is known, vertical cleavage cracks are invariably present in coatings of this sort, and, as shown in the FIG. 7 graph, a relationship exists between deposition speed and vertical crack density: the higher the deposition speed, the greater the crack density.

For each spray test, the repeated thermal stress test results shown in Table 3 are the mean values of several similar specimens. The coatings according to the invention show a repeated thermal stress life of up to 300 cycles, as compared with fewer than 5 cycles for comparison-tested 1.5 mm thick conventional dense coatings with no vertical cracks.

Figure 8:
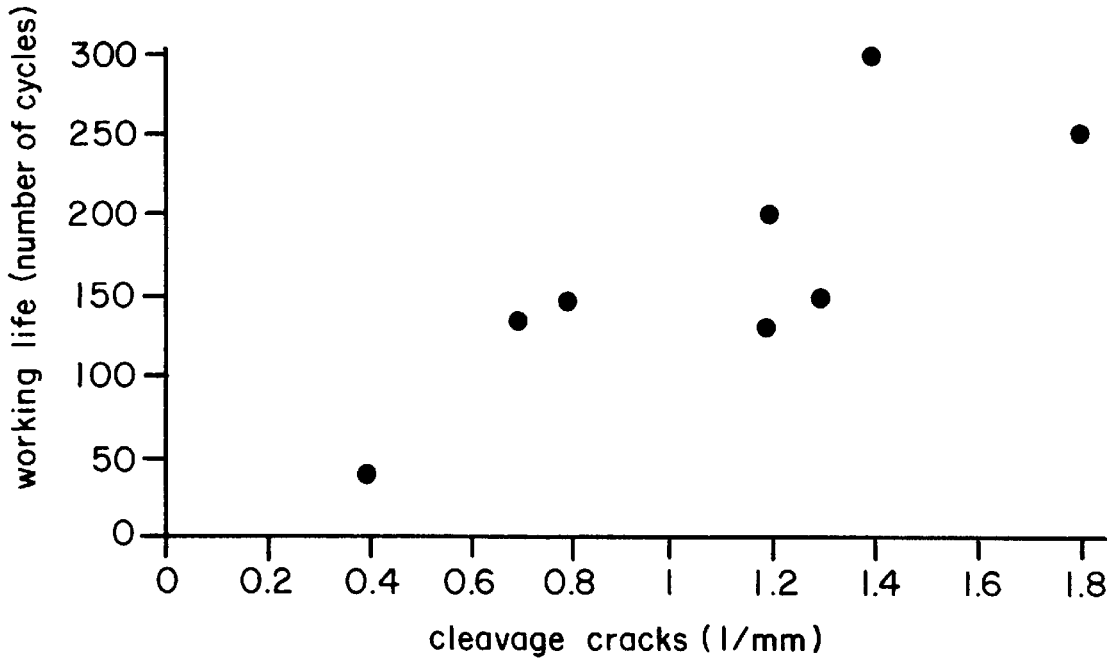
FIG. 8 shows a graph illustrating working life under repeated thermal stress versus crack density of coatings in accordance with the invention.

The FIG. 8 graph shows repeated thermal stress life versus crack density. As can be seen, a relationship obviously exists, and (as is known) the working life of thermal barrier coatings is obviously improved by the presence of vertical cracks.

As expected and confirmed by test measurements (not shown), high porosity greatly reduces thermal conductivity.

Figure 9:
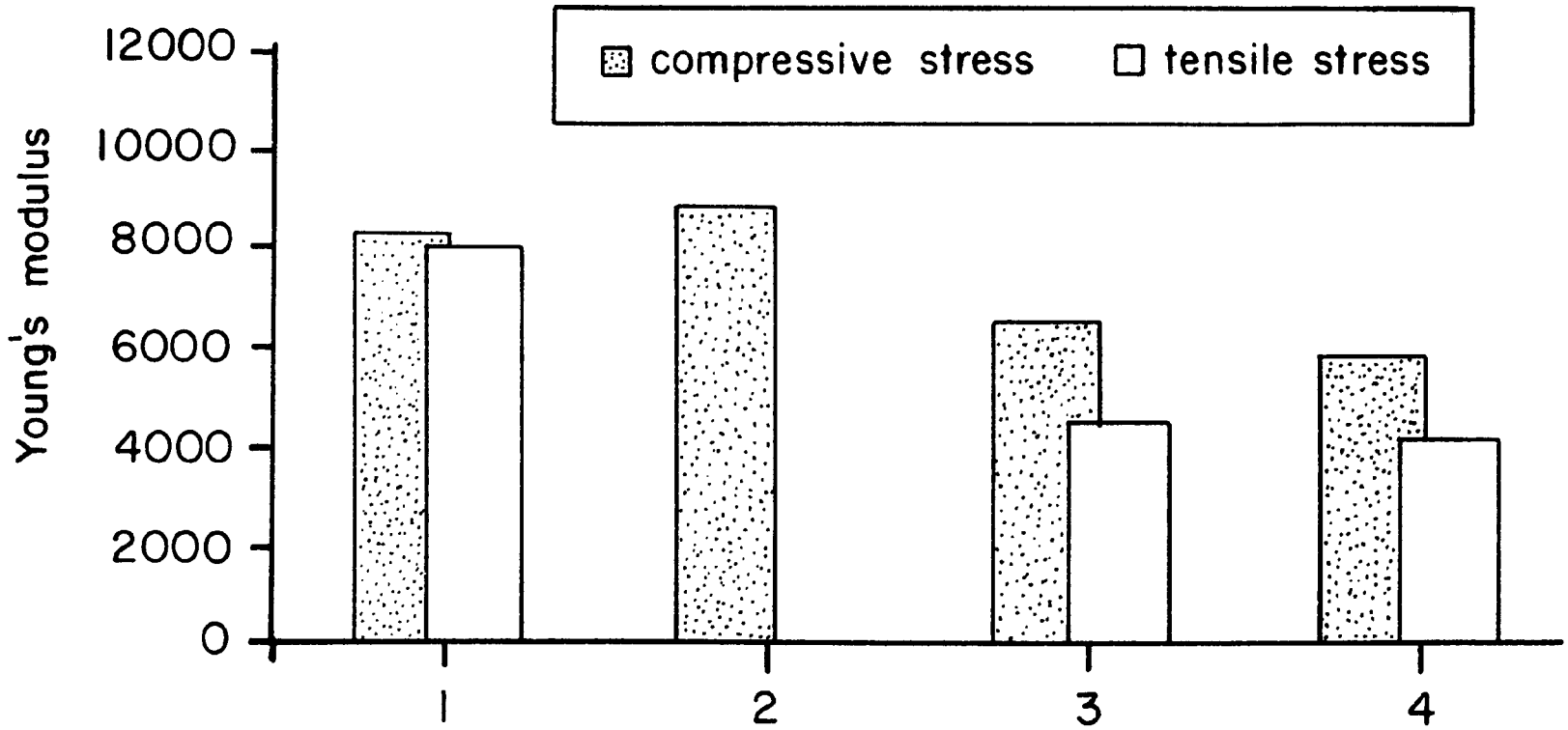
FIGS. 9 and 10 show graphs illustrating Young's modulus and the extensibility of metal specimens with a coating in accordance to the invention (last two columns in each graph) and a coating of pure zirconia (first two columns).
Figure 10:
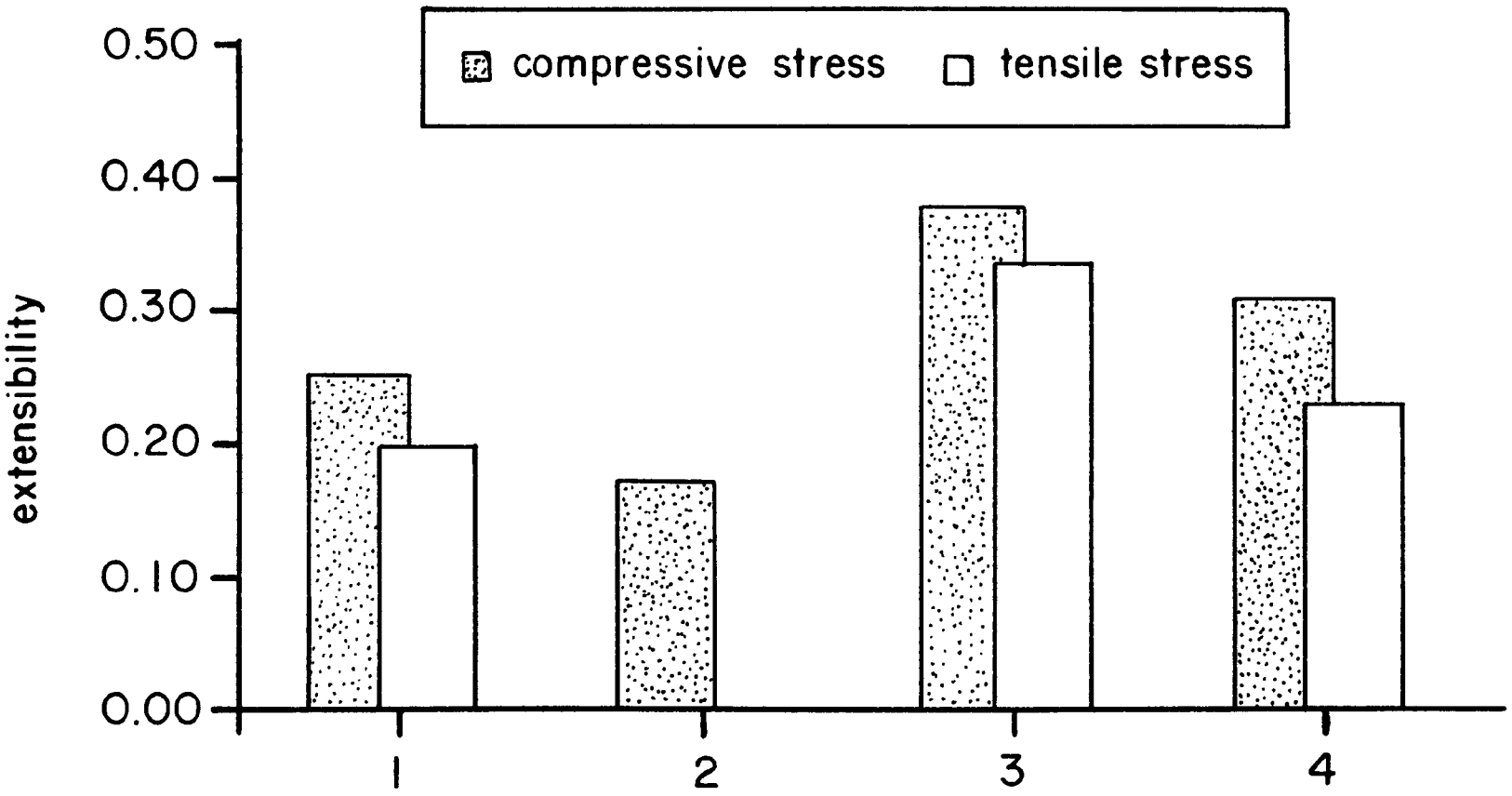

The FIGS. 9 and 10 graphs respectively show Young's modulus and the extensibility of specimens coated according to the invention (last two columns) and coated with pure zirconia (first two columns). The specimens according to the invention showed greater extensibility, a lower Young's modulus, and substantially the same modulus of rupture (not shown) as compared with specimens coated with pure zirconia. In other words, the coatings according to the invention provide for satisfactory mechanical performance, especially under cyclic stress, by virtue of the lower Young's modulus (which would appear to depend on high porosity).

We claim:

1. A method of depositing a ceramic coating on a metal substrate using a jet of plasma gas having a central axis which passes through a highest temperature region of the jet and having a medium temperature region along a peripheral portion of the jet, the method comprising the steps of:

spraying a ceramic powder onto the substrate by injecting the ceramic powder into the jet at a first injection point, the ceramic powder being injected along the central axis of the jet so as to pass through the highest temperature region of the jet and form a ceramic coating on the substrate;

spraying particles of a polymer powder onto the substrate by injecting, simultaneously with the injection of the ceramic powder, the polymer powder particles into the jet of plasma gas at a second injection point jet separated from the first injection point by a predetermined distance substantially perpendicular to the axis and at substantially the same longitudinal position, the injection of polymer powder particles being separate and independent from the injection of the ceramic powder, the polymer powder particles being injected along a path which passes through the medium temperature region of the jet such that at least some of the particles of the polymer powder are incorporated into the ceramic coating formed by the ceramic powder; and removing the polymer particles incorporated in said coating.

2. A method as claimed in claim 1, characterized in that at least one characteristic of the jet of plasma gas is regulated so as to optimize fusion and deposition on said metal substrate of said ceramic powder.

3. A method as claimed in claim 2, wherein said at least one characteristic of the jet plasma gas includes quantity of the gas, velocity of the gas, supply current and power.

4. A method as claimed in claim 1, characterized in that said step of removing said polymer particles comprises heat treatment during which said metal substrate with said ceramic coating is maintained at a predetermined temperature, higher than at least one of the decomposition and evaporation temperature of said polymer particles, for a predetermined time sufficient to completely at least one of decompose and evaporate said polymer particles.

5. A method as claimed in claim 4, characterized in that said heat treatment is conducted at 600° C. for two hours in one of air and a vacuum.

* * * * *

UNITED STATES PATENT AND TRADEMARK OFFICE

CERTIFICATE OF CORRECTION

PATENT NO. : 6,051,279

DATED : April 18, 2000

INVENTOR(S) : Giuseppe Carlo Gualco et al.

It is certified that errors appear in the above-identified patent and that said Letters Patent is hereby corrected as shown below:

Title page, [54] Item, change title to read -- METHOD AND DEVICE FOR FORMING POROUS CERAMIC COATINGS, IN PARTICULAR THERMAL BARRIER COATINGS, ON METAL SUBSTRATES --.

Page [75], Inventors, change "Turin" to -- Torino --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*